US011125398B1

(12) United States Patent
Machlis et al.

(10) Patent No.: US 11,125,398 B1
(45) Date of Patent: Sep. 21, 2021

(54) X-AXIS CURVABLE LED STRIP AND METHOD OF USE

(71) Applicants: Daniel Machlis, Arlington, TX (US); Hao Zheng, Arlington, TX (US)

(72) Inventors: Daniel Machlis, Arlington, TX (US); Hao Zheng, Arlington, TX (US)

( * ) Notice: Subject to any disclaimer, the term of this patent is extended or adjusted under 35 U.S.C. 154(b) by 0 days.

(21) Appl. No.: 16/880,922

(22) Filed: May 21, 2020

Related U.S. Application Data

(60) Provisional application No. 62/850,577, filed on May 21, 2019.

(51) Int. Cl.
*F21S 4/24* (2016.01)
*F21V 5/04* (2006.01)
*F21Y 115/10* (2016.01)

(52) U.S. Cl.
CPC *F21S 4/24* (2016.01); *F21V 5/04* (2013.01); *F21Y 2115/10* (2016.08)

(58) Field of Classification Search
CPC ..... F21S 4/24; F21V 5/04; F21Y 2115/10
See application file for complete search history.

(56) References Cited

U.S. PATENT DOCUMENTS

| | | | | |
|---|---|---|---|---|
| 9,694,744 | B2 * | 7/2017 | Bravo Solis | B60K 37/02 |
| 10,124,933 | B2 * | 11/2018 | Tseng | B65D 33/2508 |
| 10,125,933 | B1 * | 11/2018 | Machlis | F21V 21/04 |
| 2007/0249939 | A1 * | 10/2007 | Gerbi | A61B 8/0841 600/462 |
| 2017/0268759 | A1 * | 9/2017 | Yao | F21V 15/015 |
| 2018/0320840 | A1 * | 11/2018 | Machlis | F21V 23/003 |
| 2019/0309917 | A1 * | 10/2019 | Santos | F21V 3/00 |

* cited by examiner

*Primary Examiner* — Rajarshi Chakraborty
*Assistant Examiner* — Glenn D Zimmerman
(74) *Attorney, Agent, or Firm* — Leavitt Eldredge Law Firm; Richard Eldredge

(57) ABSTRACT

An x-axis curvable LED strip includes an elongated curved channel having a bottom portion and one or more walls extending therefrom; an elongated lens to secure over a top of the elongated curved channel; and a flexible light strip, having a mounting strip to secure to one of the one or more walls of the elongated curved channel; LED lights attached to the mounting strip by an extension such that the LED lights are positioned within the elongated curved channel along the bottom portion; the LED lights emit light through the elongated lens.

6 Claims, 8 Drawing Sheets

X-AXIS CURVABLE LED STRIP AND METHOD OF USE

BACKGROUND

1. Field of the Invention

The present invention relates to the field of lighting, and more particularly, the field of LED-based flexible strip lighting.

2. Description of Related Art

There are many kinds of linear lighting apparatuses. Many of the most recent ones consist of light emitting diodes (LEDs) as light sources. LEDs can be mounted onto a flexible substrate (called an LED strip or LED tape light) and can be provided in a fixture (typically aluminum) with a diffuser (typically acrylic, polycarbonate, or silicone) to produce a clean line of light. Strip lighting has uses in both coves as accent light and in functional lighting instruments used for task lighting.

One limitation that exists in strip lighting is its inability to turn corners. There are currently some solutions on the market to this challenge, including flexible strip lighting that has some kind of design that allows for x-axis bending. However, these designs are imperfect due to the geometry of the printed circuit board (PCB), leading to tape light that has parts raised off the surface of the fixture in order to make the turn. Another option would be to use a plastic-based quick connector, which are limited in that it can create a dark spot in addition to not being able to fit inside many fixtures. One final option would be to have jumper wires soldered onto the tape light which still has the limitation of potentially creating a dark spot.

In FIG. 1, one example of a curved LED apparatus 101 is shown, having a channel 105 with one or more LEDs 103 secured to the interior side walls, and having one or more clips 109 for mounting. A lens 107 is positioned to diffuse the light emitted therefrom. In this example, the channel 105 and lens 107 can be curved, however, this embodiment has limitations including cost and fixture efficiency. This example requires the mounting of two strips within the channel, which is not cost effective, and further, light is lost as the light is not directed directly at the lens.

Accordingly, although great strides have been made in the area of LED based strip lighting, many shortcomings remain.

Embodiments of the present invention include an x-axis curvable LED strip that only requires one strip of LEDs and positions the LEDs to emit light directly through a lens, thereby reducing the light loss.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
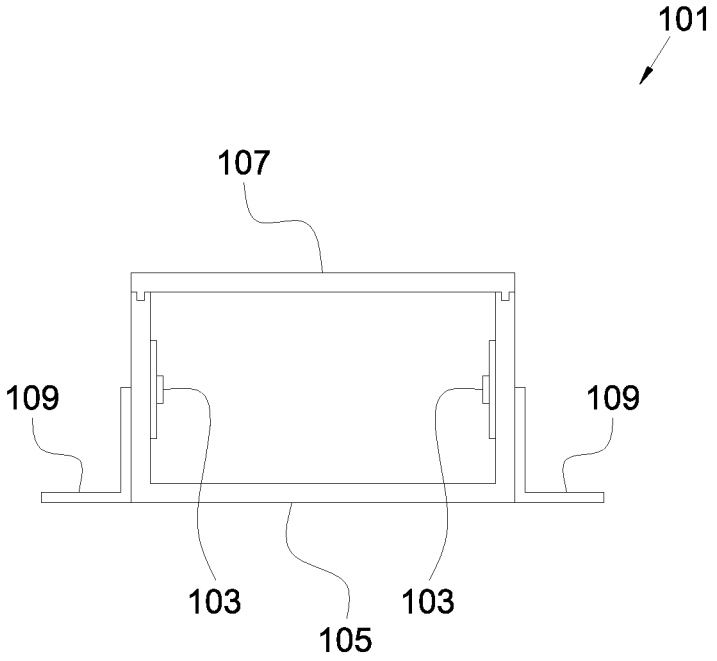
FIG. 1 (PRIOR ART)
FIG. 1 is an end view of a prior art LED apparatus.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional LED strips. Specifically, the system of the present invention provides for an x-axis curvable LED strip that only requires one light strip and provides for a plurality of LEDs to emit light directly through a lens, thereby reducing light lost. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
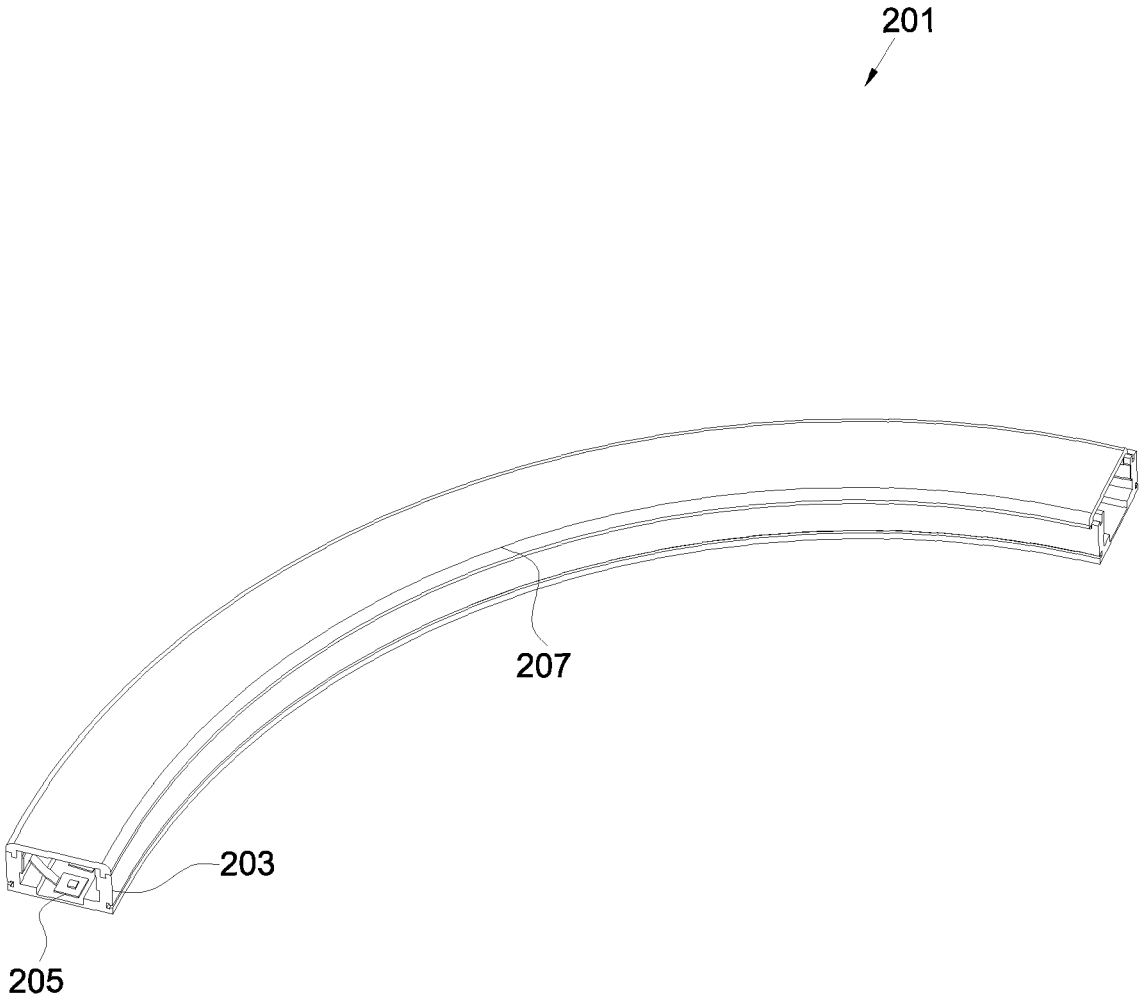
FIG. 2 is an isometric view of an x-axis curvable LED strip with a channel shaped in a curve angle in accordance with a preferred embodiment of the present application.
Figure 3:
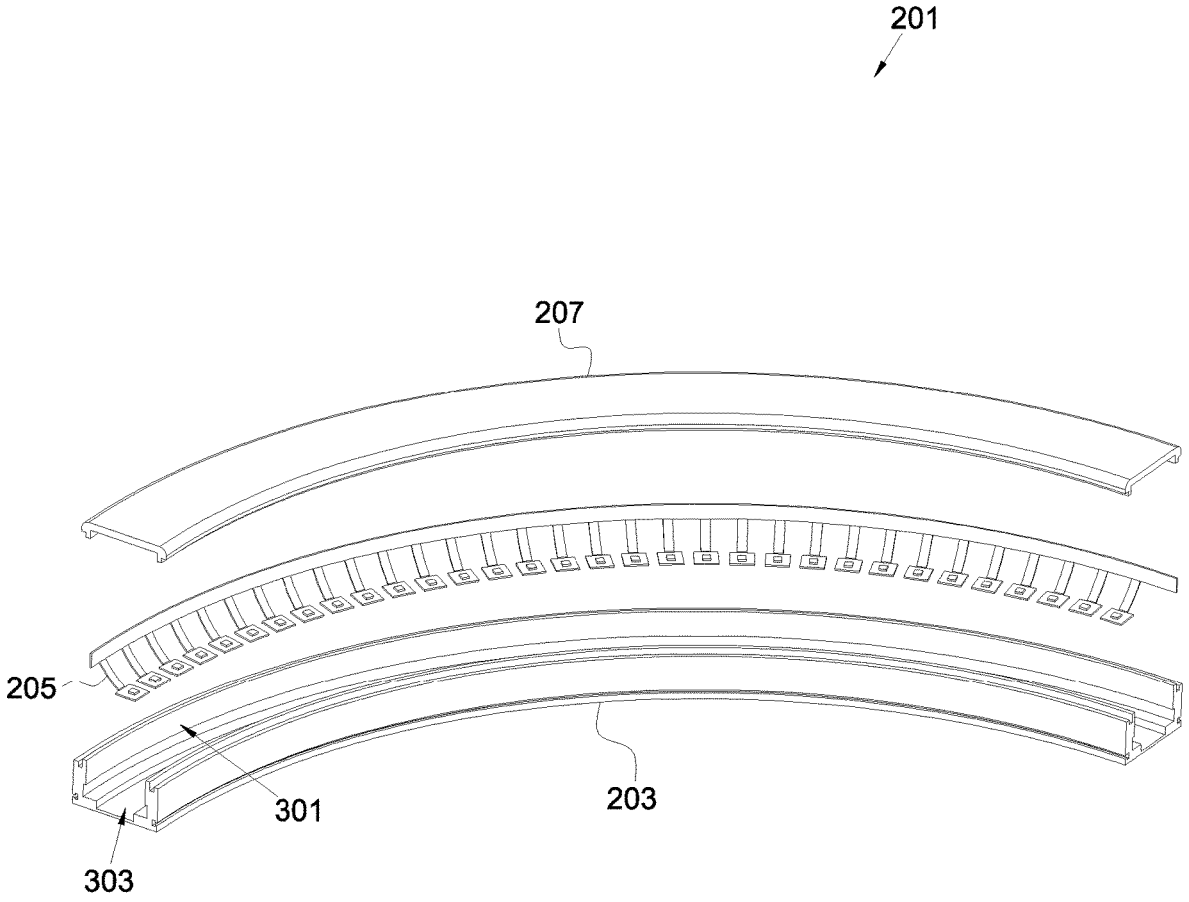
FIG. 3 is an exploded view of the x-axis curvable LED strip of FIG. 2.

Referring now to the drawings wherein like reference characters identify corresponding or similar elements throughout the several views, FIGS. 2 and 3 depict isometric views of an x-axis curvable LED strip system 201 having a channel shaped in a curved angle in accordance with a preferred embodiment of the present application. It will be appreciated that system 201 overcomes one or more of the above-listed problems commonly associated with conventional LED strips.

In the contemplated embodiment, system 201 includes an elongated curved channel 203 having a bottom portion 303 and one or more sidewalls 301 extending therefrom. It should be appreciated that the elongated curved channel 203 can be designed with various curve angles and lengths and can be composed of any suitable material, such as aluminum. System 201 further includes an elongated lens 207 configured to secure over the top of the elongated channel 203 and to the elongated channel 203.

In the preferred embodiment, a flexible light strip 205 is secured and positioned within the elongated channel. It should be appreciated that one of the unique features believed characteristic of the present application is the flexible light strip 205 which provides for the ability to utilize a single strip and position a plurality of LEDs 407 such that they will emit light directly through the lens 207.

Figure 4:
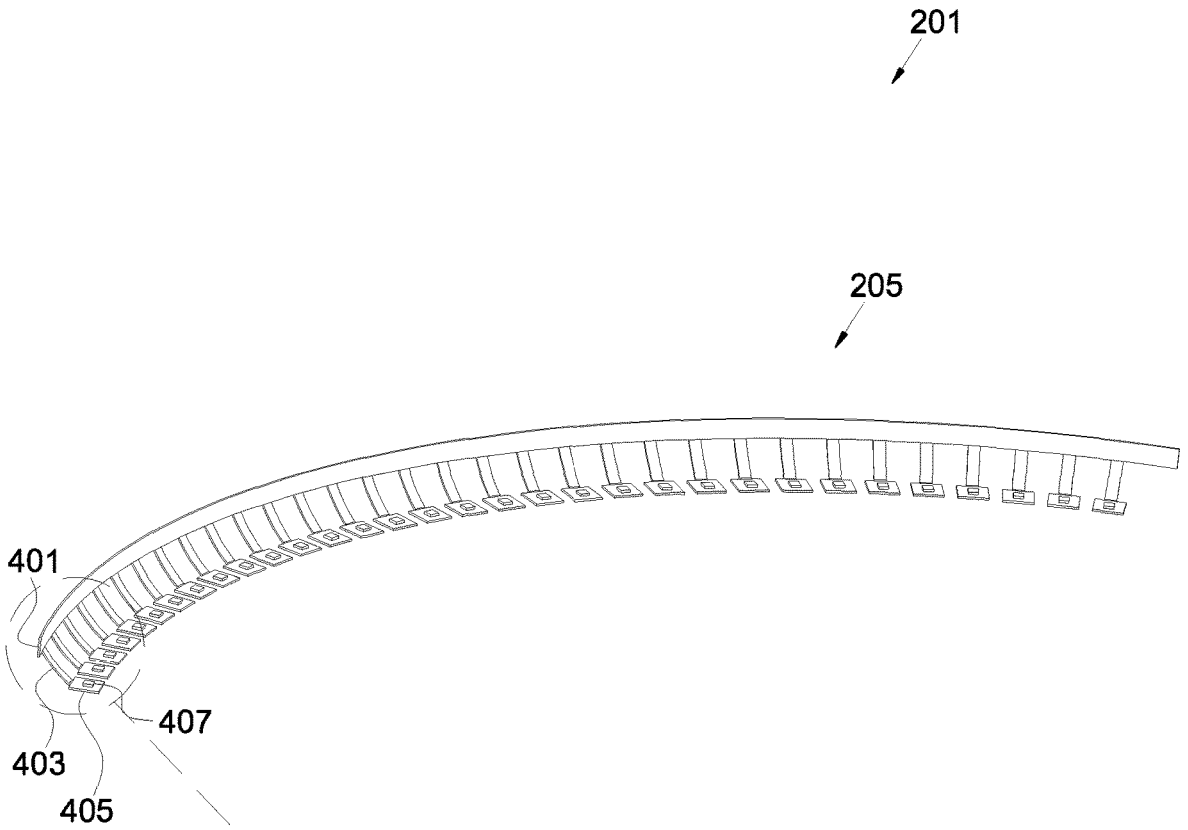
FIG. 4 is an isometric view of a light strip of FIG. 2.
Figure 5:
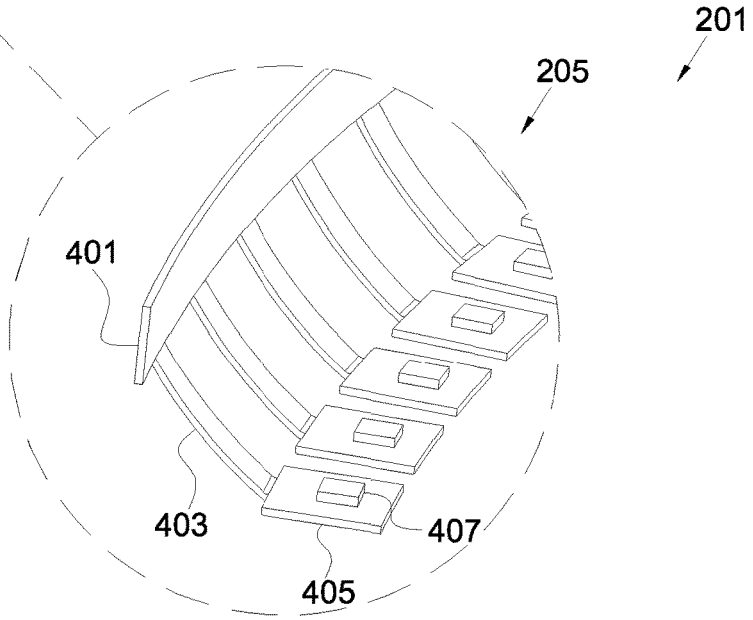
FIG. 5 is an exploded isometric view of the light strip of FIG. 4.
Figure 6:
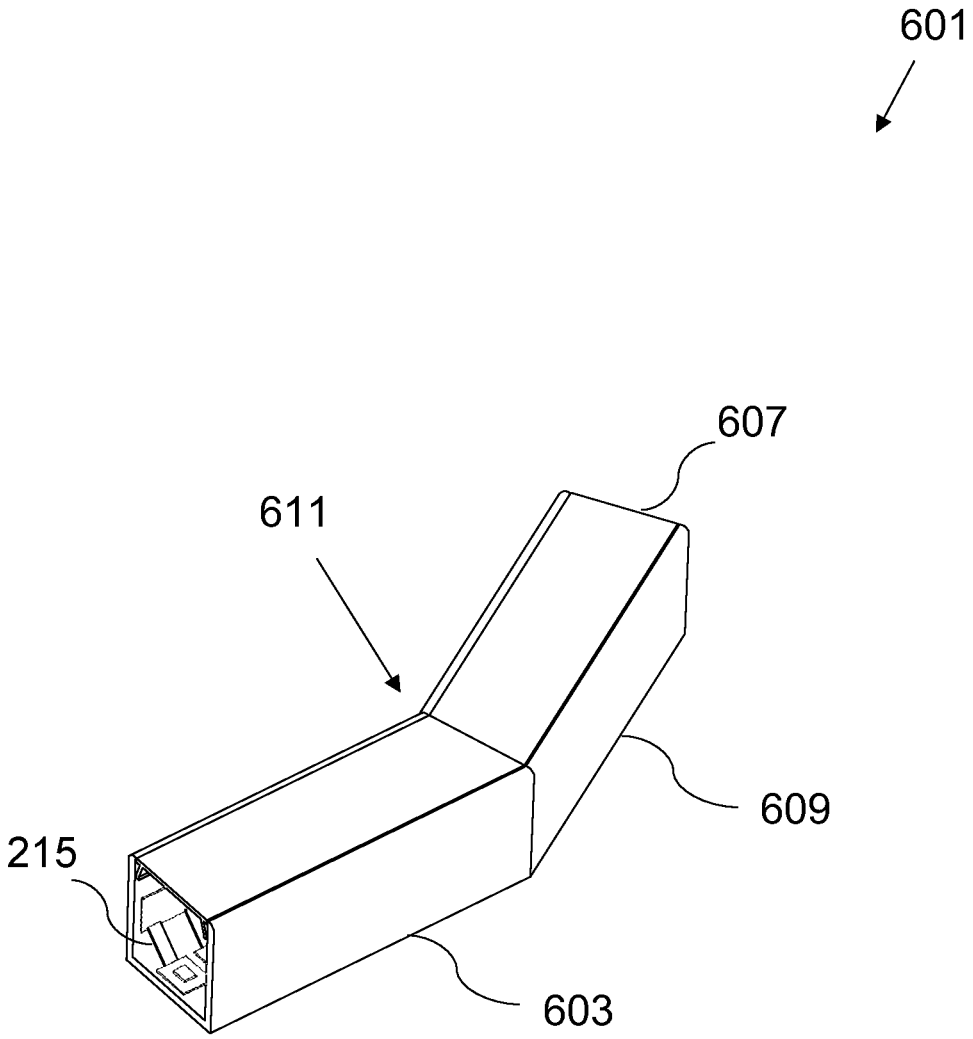
FIG. 6 is an isometric view of an x-axis curvable LED strip with a channel shaped in a straight angle in accordance with an embodiment of the present application.
Figure 7:
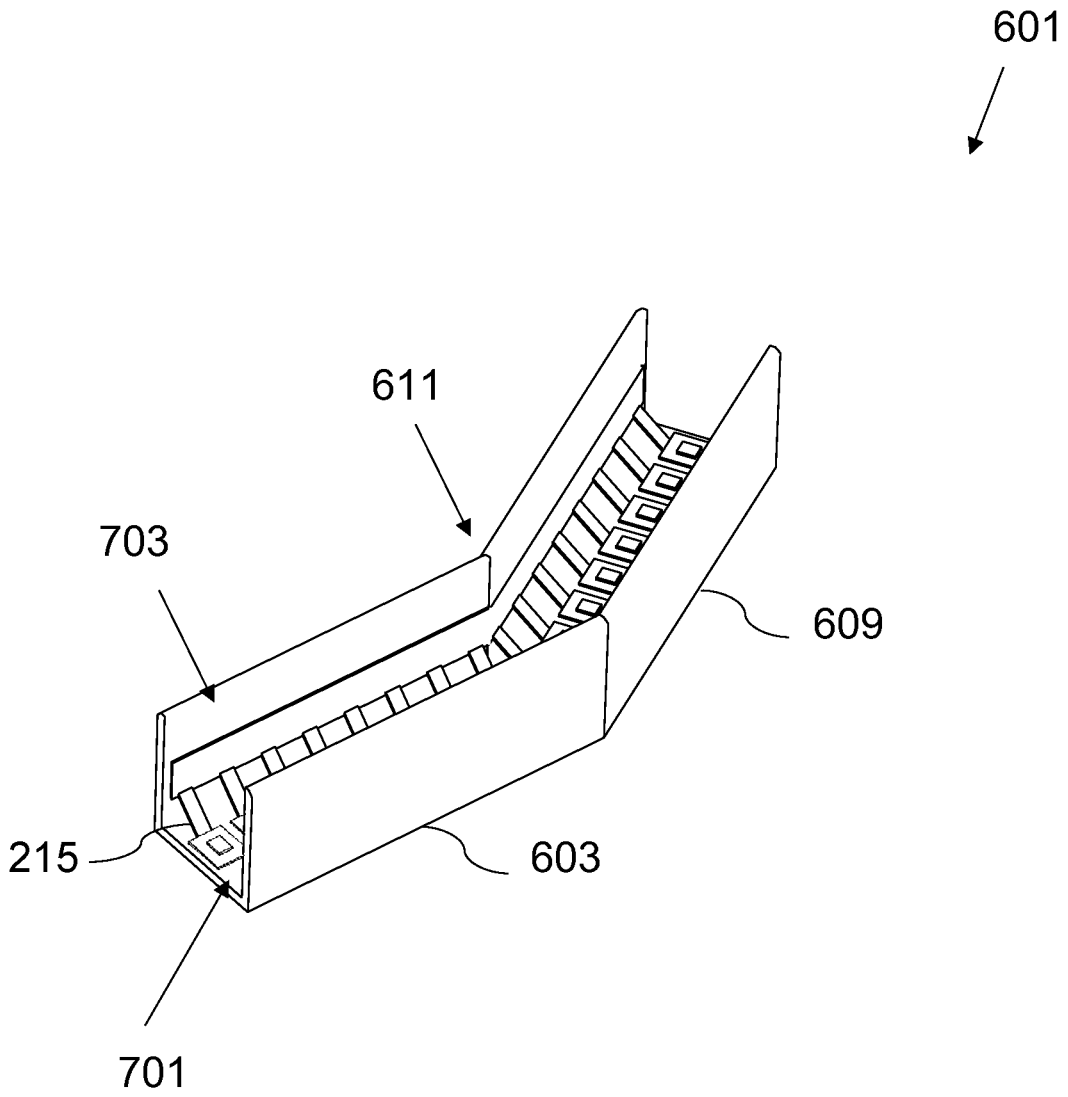
FIG. 7 is a disassembled isometric perspective view of the x-axis curvable LED strip of FIG. 6.
Figure 8:
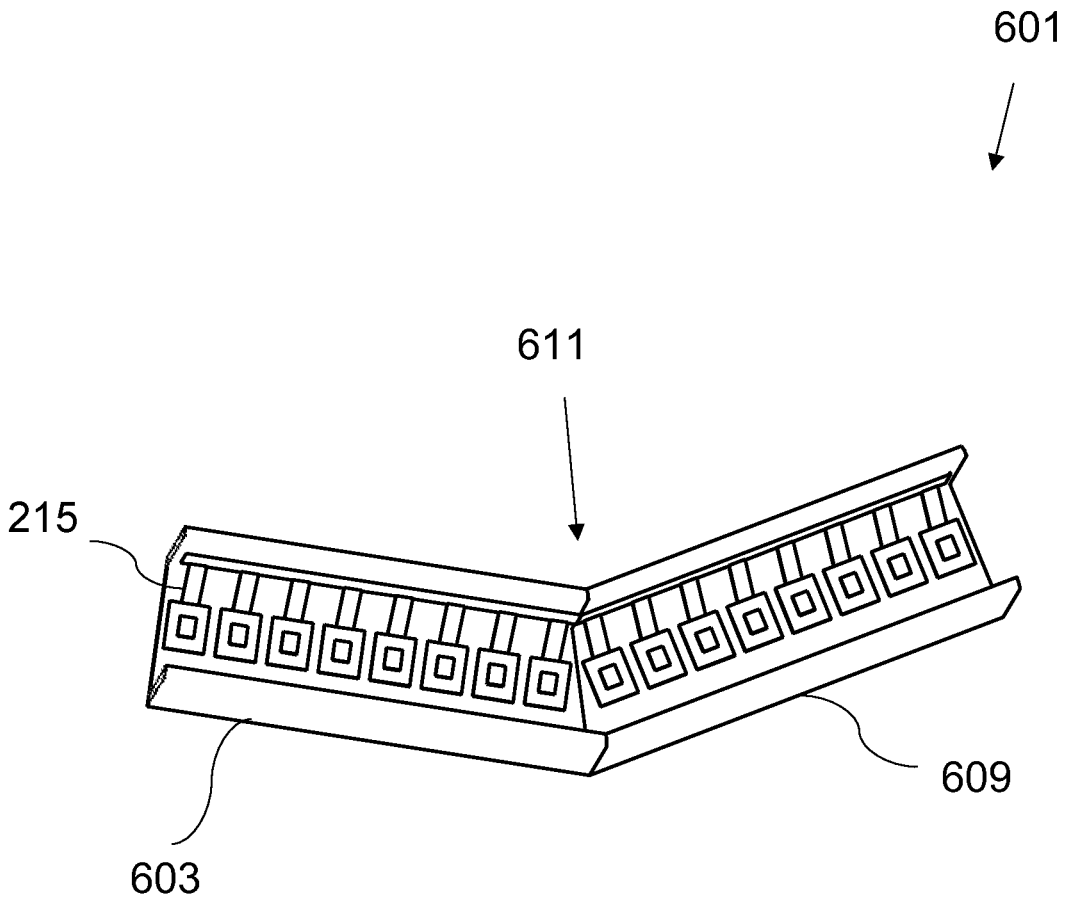
FIG. 8 is a disassembled isometric top view of the x-axis curvable LED strip of FIG. 6.
Figure 9:
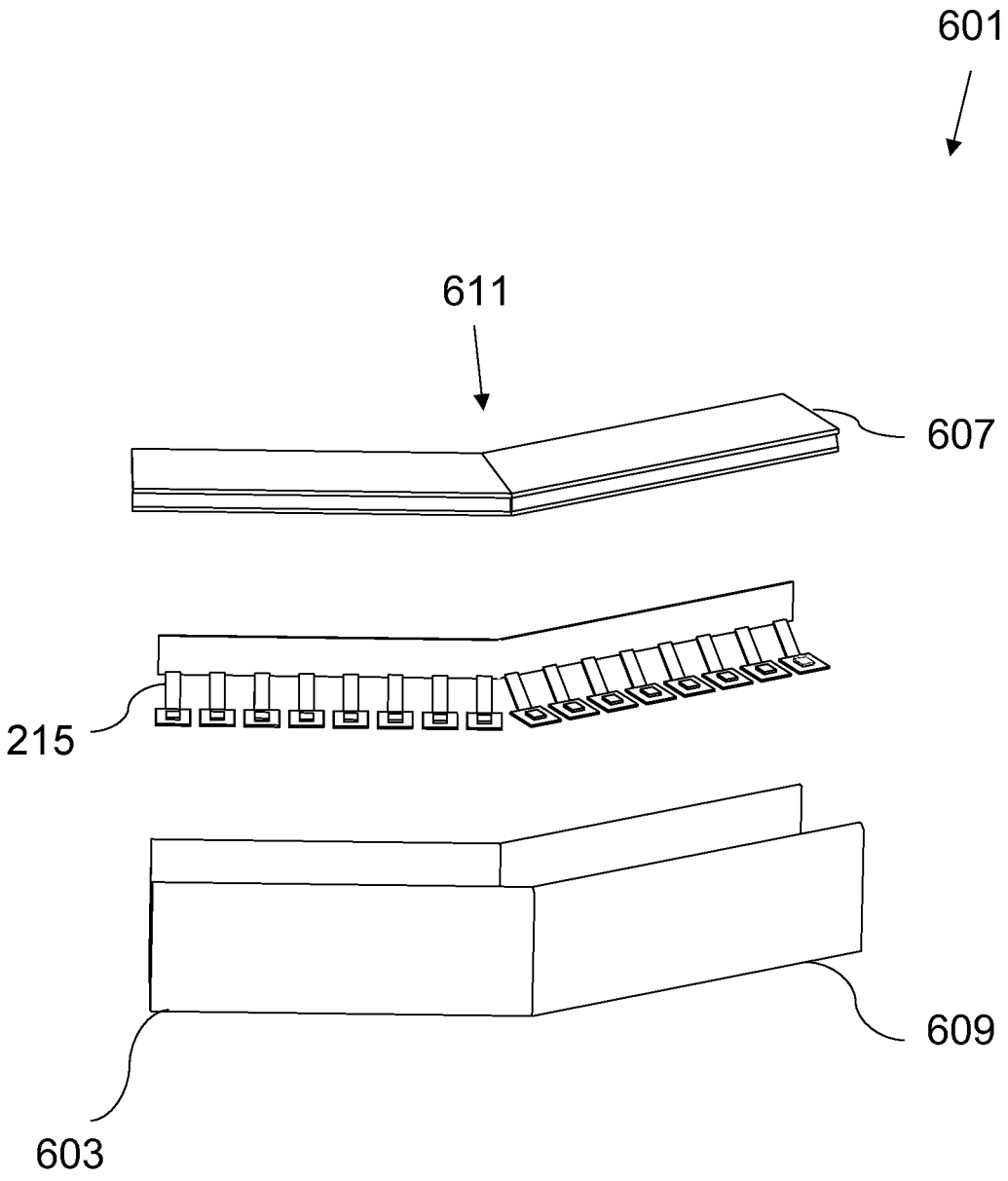
FIG. 9 is an exploded isometric view of the x-axis curvable LED strip of FIG. 6.

In FIGS. 4 and 5, the flexible light strip 205 is shown. The flexible light strip 205 includes a mounting strip 401. In the preferred embodiment, the mounting strip 401 is flexible and configured to extend at least a partial length of the elongated channel. As shown, the mounting strip 401 attaches to one of the one or more walls 301 of the channel, thereby following the curve of the channel. As shown, a plurality of LED plates 405 with a plurality of LEDs 407 are connected to the mounting strip 401 by a plurality of extension strips 403. As shown, the extension strips 403 extend from the side wall 301 down to the bottom portion 303, thereby positioning the plurality of LEDs along the bottom, while retaining the flexibility of the strip. In the preferred embodiment, the LED plates 405 are connected at an angle greater than 90, thereby allowing for directing the light directly through the lens 207. It should be appreciated that the length of light strip 205 can vary based on the user needs.

During use, system 201 can be configured and mounted as desired by the user, such as for functional or aesthetical purposes. Assembling system 201 requires providing the elongated curved channel, securing the light strip therein, such that the mounting strip 401 is secured to a wall and the plurality of LEDs are positioned along the bottom portion, and securing the lens over the top. The user can then use the system 201 as desired.

Referring now to FIGS. 6 through 9, isometric views of an x-axis curvable LED strip system 601 having a channel shaped in a straight angle in accordance with an embodiment of the present application are shown.

In the contemplated embodiment, system 601 includes an elongated straight channel 603 having a bottom portion 701 and one or more sidewalls 703 extending therefrom. It should be appreciated that the elongated straight channel 603 can be intersecting with another elongated straight channel, for instance, second elongated straight channel 609, at angle 611. It should also be appreciated that angle 611 can include 1 degree through 359 degrees. System 601 further includes an elongated lens 607 configured to secure over the top of the elongated straight channel 603 and to the elongated straight channel 603.

It is contemplated and will be appreciated that the elongated straight channel 603 and the second elongated channel 609 can be designed with various lengths and can be composed of any suitable material, such as aluminum.

In the preferred embodiment, the flexible light strip 215 from system 201 is secured and positioned within the elongated straight channel 603. It should be appreciated that one of the unique features believed characteristic of the present application is the flexible light strip 215 which provides for the ability to utilize a single strip and position a plurality of LEDs 407 such that they will emit light directly through the lens 607.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An x-axis curvable light emitting diode (LED) strip system, comprising:

an elongated curve channel having a bottom portion and one or more walls extending therefrom, the elongated curve channel is composed of an aluminum material, the elongated curve extending an angle between 1 degree to 359 degrees;

an elongated lens configured to secure over a top of the elongated curved channel, the bottom portion, the one or more walls and the elongated lens forming an elongated cavity; and a flexible light strip disposed within the elongated cavity, the flexible light strip having:

a mounting strip configured to secure to an inner surface of the one or more walls of the elongated curved channel;

a plurality of extension strips integral with and extending from the mounting strip; and a plurality of LED lights attached to the mounting strip by the plurality of extension strips;

wherein the plurality of LED lights are positioned within the elongated curved channel along the bottom portion of the elongated lens; and wherein the plurality of LED lights emit light through the elongated lens.

2. The x-axis curvable LED strip of claim 1, wherein the elongated curve channel is shaped to at least one or more desired lengths, one or more shapes, one or more angles, or a combination thereof.

3. The x-axis curvable LED strip of claim 1, wherein the flexible light strip is shaped to at least one or more desired lengths, shapes, angles, or a combination thereof.

4. The x-axis curvable LED strip of claim 1, wherein the plurality of LED lights are positioned parallel to the elongated lens.

5. A method of installing curved LED illuminating devices, the method comprising:

providing the curved LED strip of claim 1;

securing a flexible light strip within the elongated curved channel, the flexible light strip having a mounting strip to secure to one of the one or more walls of the elongated curved channel, and the flexible light strip further having a plurality of LED lights attached to the mounting strip by a plurality of extension strips such that the plurality of LED lights are positioned within the elongated curved channel along the bottom portion; securing an elongated lens over the flexible light strip and to the elongated curved channel; and positioning the assembled curved LED illuminating device onto a fixture having one or more sides with one or more angles;

wherein the plurality of LED lights emit light through the elongated lens.

6. The x-axis curvable LED strip of claim 2, wherein the angle of an elongated curve channel includes ranges of 1 degree through 359 degrees.

* * * * *